US005707596A

United States Patent [19]

Lewandowski et al.

[11] Patent Number: 5,707,596

[45] Date of Patent: Jan. 13, 1998

[54] METHOD TO MINIMIZE CHEMICALLY BOUND NOX IN A COMBUSTION PROCESS

[75] Inventors: David A. Lewandowski, Belle Vernon; Peter B. Nutcher, Canonsburg; Peter J. Waldern, Bethel Park, all of Pa.

[73] Assignee: Process Combustion Corporation, Pittsburgh, Pa.

[21] Appl. No.: 555,041

[22] Filed: Nov. 8, 1995

[51] Int. Cl.[6] ..... B01D 53/56

[52] U.S. Cl. ..... 423/235; 431/5

[58] Field of Search ..... 423/235; 431/5; 110/210, 215

[56] References Cited

U.S. PATENT DOCUMENTS

| | | | |
|---|---|---|---|
| 3,873,671 | 3/1975 | Reed et al. | 423/235 |
| 3,973,899 | 8/1976 | Reed et al. | 431/202 |
| 4,033,725 | 7/1977 | Reed et al. | 23/277 C |
| 4,208,386 | 6/1980 | Arand et al. | 423/235 |
| 4,231,333 | 11/1980 | Thatcher et al. | 123/440 |
| 4,325,924 | 4/1982 | Arand et al. | 423/235 |
| 4,405,587 | 9/1983 | McGill et al. | 423/235 |
| 4,417,547 | 11/1983 | Goodman et al. | 123/253 |
| 4,447,203 | 5/1984 | Hampton et al. | 431/3 |
| 4,474,121 | 10/1984 | Lewis | 110/346 |
| 4,533,314 | 8/1985 | Herberling | 431/4 |
| 4,538,981 | 9/1985 | Venturini | 431/190 |
| 4,714,032 | 12/1987 | Dickinson | 110/347 |
| 4,731,231 | 3/1988 | Perry | 423/235 |
| 4,773,846 | 9/1988 | Munk | 431/4 |
| 4,779,545 | 10/1988 | Breen et al. | 110/212 |
| 4,824,441 | 4/1989 | Kinding | 44/604 |
| 4,842,617 | 6/1989 | Kukin | 44/51 |
| 4,861,567 | 8/1989 | Heap et al. | 423/235 |
| 4,886,650 | 12/1989 | Perry | 423/235 |
| 4,982,672 | 1/1991 | Bell | 110/346 |
| 5,020,457 | 6/1991 | Mathur et al. | 110/345 |
| 5,061,463 | 10/1991 | Vickery | 423/210 |
| 5,118,282 | 6/1992 | Reynolds et al. | 431/4 |

(List continued on next page.)

FOREIGN PATENT DOCUMENTS

| | | | |
|---|---|---|---|
| 2855766 | 6/1979 | Germany | 431/5 |
| 53-112273 | 9/1978 | Japan | 423/235 |

OTHER PUBLICATIONS

"NOxTech: A New NOx Reduction System for Internal Combustion Engines", Cummins Power Generation, Inc. brochure, Feb. 1994 Cummins Power Generation, Inc. Box 3005 M.C. 60125 Columbus, Indiana 47202–3005 Bulletin CPG–N9100.

*Primary Examiner*—Gary P. Straub
*Assistant Examiner*—Timothy C. Vanoy
*Attorney, Agent, or Firm*—Webb Ziesenheim Bruening Logsdon Orkin & Hanson, P.C.

[57] ABSTRACT

The present invention is directed to a method which significantly improves the efficiency of reducing nitrogen oxide formation and emission during incineration of a waste gas in an air-staged thermal oxidizer. In accordance with the present invention, a natural gas stream is mixed with combustion air in a burner and the mixture is ignited with the immediate introduction of liquid water. Thus, the resulting mixture is then injected into a first reducing zone which is fuel rich in order to begin the combustion process, but retard the formation of nitrogen oxides. The waste gas exiting the reducing zone is deficient in oxygen due to the fuel rich atmosphere in the first reducing zone and cooler due to the water cooling as it enters the second oxidizing zone. In the second oxidizing zone, additional oxygen in the form of air is injected to complete the combustion process. Due to the fact that the waste gas is cooler in the oxidizing zone, the peak temperature resulting from completion of combustion reactions is lower and thermal nitrogen oxide formation is minimized in the second oxidizing zone. In another embodiment, the method of the present invention further includes the step of mixing chemical reagents with the cooling water prior to injection into either the reducing zone, the oxidizing zone, or both, to chemically reduce nitrogen oxides present in gases emanating from the reducing zone and to reduce formation of nitrogen oxides in the oxidizing zone.

12 Claims, 1 Drawing Sheet

AIR STAGED THERMAL OXIDIZER

U.S. PATENT DOCUMENTS

| | | | |
|---|---|---|---|
| 5,129,818 | 7/1992 | Balsiger | 431/4 |
| 5,139,755 | 8/1992 | Seeker et al. | 423/235 |
| 5,181,475 | 1/1993 | Breen et al. | 110/345 |
| 5,199,255 | 4/1993 | Sun et al. | 60/39.02 |
| 5,217,373 | 6/1993 | Goodfellow | 432/81 |
| 5,240,689 | 8/1993 | Jones | 423/235 |
| 5,242,295 | 9/1993 | Ho | 431/10 |
| 5,249,952 | 10/1993 | West et al. | 431/5 |
| 5,269,235 | 12/1993 | McGill et al. | 110/246 |
| 5,284,437 | 2/1994 | Aigner | 431/4 |
| 5,336,081 | 8/1994 | Saito et al. | 431/4 |
| 5,342,599 | 8/1994 | Slone | 423/365 |
| 5,367,876 | 11/1994 | Harper, III | 60/310 |

AIR STAGED THERMAL OXIDIZER

METHOD TO MINIMIZE CHEMICALLY BOUND NOX IN A COMBUSTION PROCESS

BACKGROUND OF THE INVENTION

1. Field of the Invention

The present invention relates generally to a method for cleaning waste gases, and more particularly to a method for reducing nitrogen oxide emissions from a waste gas utilizing a thermal oxidation process.

2. Description of the Prior Art

One method of reducing nitrogen oxide emissions from a waste gas known in the art utilizes a two-stage thermal oxidation process. Such a process is disclosed in U.S. Pat. No. 5,242,295 to Ho entitled "Combustion Method For Simultaneous Control Of Nitrogen Oxides And Products Of Incomplete Combustion".

In a two-stage process, the waste gas is injected into a first-stage or zone of an air-staged thermal oxidizer. This first-stage is a chemically reducing zone having a fuel rich zone in which the waste gas is chemically reduced. The waste gas is then transferred to a second stage or zone within the air-staged thermal oxidizer which is an oxidizing zone, where the waste gas is oxidized. Ho explains that his two-stage system resulted from prior art attempts to reduce products of incomplete combustion (PICs) during the combustion of hazardous waste. Prior to Ho's invention, the approach taken in the art was to inject additional oxygen in the combustion zone in an effort to reduce PICs. While PICs were so reduced, the additional oxygen resulted in the formation of undesirable nitrogen oxides. The two-stage system developed in response to this problem provided for a first reducing zone to provide a more stable temperature and to produce products of both complete and incomplete combustion, and to reduce the fuel requirements in the second zone. Upon entering the second zone, the PICs formed in the reducing zone are transformed into products of complete combustion in the oxidizing atmosphere and higher temperature of the second zone. The waste gas emanating from the second zone typically flows to an off-gas stack and is theoretically low in nitrogen oxides.

A major limitation associated with known two-stage processes for reducing nitrogen oxide formation and emissions during incineration of waste gases is that such systems exhibit very poor $NO_x$ destruction efficiencies, resulting in minimal reduction in the formation and emission of nitrogen oxides.

Thus a need exists in the art for an efficient method of reducing the formation and emission of nitrogen oxides during the incineration of waste gases.

SUMMARY OF THE INVENTION

The present invention is directed to a method which significantly improves the efficiency of reducing nitrogen oxide formation and emission during incineration of a waste gas in an air-staged thermal oxidizer. In accordance with the present invention, the present inventors have found that when water is injected into a natural gas stream and is mixed with combustion air in a burner, ignited and is then injected into a first reducing zone, the water cools the gases in this reducing zone by transfer of heat as the water evaporates into steam. The waste gas exiting the reducing zone is deficient in oxygen due to the fuel rich atmosphere in the first reducing zone and is cooler due to the water cooling as it enters the second oxidizing zone. In the second oxidizing zone, additional oxygen in the form of air, termed "combustion air" is injected to complete the combustion process. Due to the fact that the waste gas is cooler in the oxidizing zone, the peak temperature resulting from the completion of combustion reactions is lower than heretofore known in the art and thermal nitrogen oxide formation is thereby minimized in the second oxidizing zone.

In an alternative embodiment, the method of the present invention further includes the step of reducing nitrogen oxide emissions by also injecting additional water into the oxidizing zone, along with air to complete the combustion of the oxygen deficient gases exiting from the reducing zone. The peak temperature at which the oxidation reactions are completed in the oxidizing zone is reduced by virtue of the injection of an atomized water spray into the air in the second zone. Atomization of the water can be achieved by using high pressure water nozzles on the order of greater than 60 psig or by using part of the oxidation air to atomize the water spray.

In still another embodiment, the method of the present invention further includes the steps of mixing chemical reagents with the cooling water when entering the reducing zone and/or the oxidizing zone prior to injection into the respective zone. The chemical reagents chemically reduce nitrogen oxides present in gases emanating from the reducing zone and reduce formation of nitrogen oxides in the oxidizing zone. The chemical reagents effective for chemically reducing the nitrogen oxides which may have been formed in the first zone, and which also function to reduce nitrogen oxide formation in the second zone, are characterized by H-N atomic bonds as part of their overall chemical structure. Preferred chemical reagents include one or more of cyanuric acid, urea or ammonium carbonate. Injection of an aqueous solution of these reagents provides a dual role of: 1) chemically reducing nitrogen oxide formed in the reducing zone; and 2) preventing the formation of nitrogen oxides in the oxidizing zone.

The use of water injection in a first-stage reducing zone of an air-staged thermal oxidizer, along with the injection of combustion air, water and a chemical agent in either the first-stage reducing zone or second-stage oxidizing zone, is a novel and unobvious advance over the art heretofore known.

DESCRIPTION OF THE PREFERRED EMBODIMENTS

Figure 1:
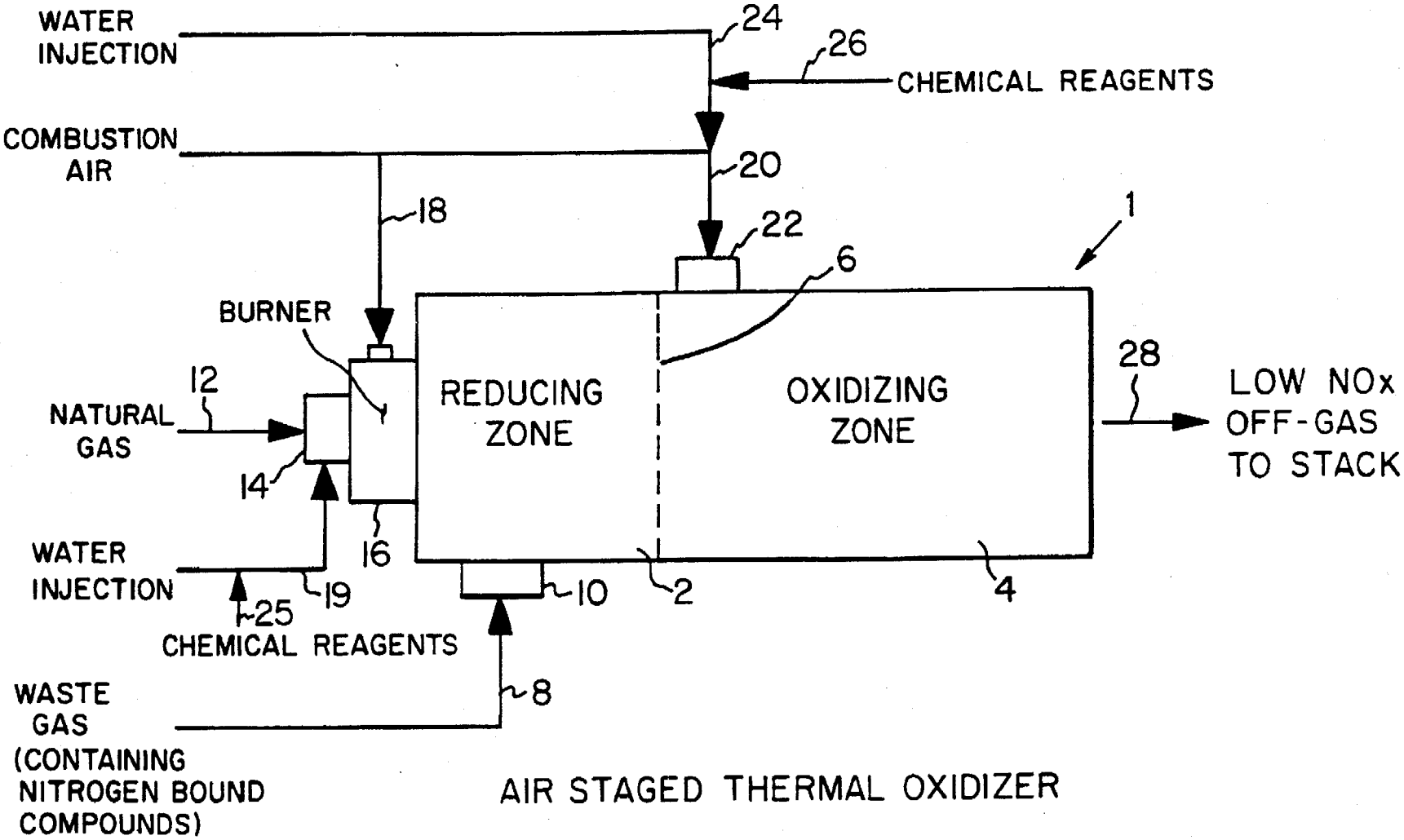
FIG. 1 is a schematic representation of a two-staged thermal oxidizer.

Referring now to FIG. 1, there is shown an air-staged thermal oxidizer 1 compatible for use with the method of the present invention. Thermal oxidizer 1 includes an interior burn chamber which is comprised of reducing zone 2 and oxidizing zone 4. Line 6, shown in phantom, roughly separates the zones, but it is to be understood that the zones 2 and 4 are separated by an air curtain as opposed to a physical separation. Waste gas which contains nitrogen bound compounds is provided to thermal oxidizer 1 via conduit 8 and is introduced into thermal oxidizer 1 via waste gas inlet port 10. Natural gas is provided via conduit 12 and is introduced into a burner inlet port 14 and into burner 16 which is in fluid communication with burner inlet port 14. Air for combustion is introduced via conduit 18 into burner 16 and is admixed with the natural gas in burner 16. The air/natural gas mixture is ignited, and the burning gas is directed into the reducing zone 2 of the thermal oxidizer 1.

The air/natural gas ratio is controlled to provide a fuel rich atmosphere in reducing zone 2. The waste gas introduced into reducing zone 2 via waste gas inlet port 10 is incinerated in the presence of the burning natural gas introduced via burner 16 into reducing zone 2.

With the method of the present invention, water is injected via conduit 19 into burner inlet port 14 and is admixed with the natural gas before entering burner 16. The water cools the gases in reducing zone 2 by transfer of heat as the water evaporates into steam. The waste gas exiting the reducing zone 2 is deficient in oxygen due to the fuel rich atmosphere in the first reducing zone 2 and cooler due to the water cooling, as it enters the oxidizing zone 4. The temperature in the reducing zone 2 is maintained in the range of 1500° to 1600° F. (815°–871° C.). This is a substantial reduction over prior art temperature ranges for the reducing zone 2.

While flow rates and waste gas residence times in reducing zone 2 can vary dependent upon the scale of the operation involved, the equipment and flow rates obtained by the inventors is as follows. Waste gas conduit 8 was a 42 inch diameter metal pipe in which the waste gas was provided at a pressure of 6 inches w.c. and a flow rate of 20,000 scfm into thermal oxidizer 1. Natural gas conduit 12 was a 3 inch diameter metal pipe in which the natural gas was provided at a pressure of 7 psig and at a flow rate of 40 scfm. Combustion air conduit 18 was a 24 inch diameter metal pipe in which the combustion air flow was provided at a pressure of 10 inches w.c. and at a flow rate of 2000 scfm. Water injection conduit 19 was a 1 inch diameter metal pipe in which the water flow was provided at a pressure of 60 psig and a flow rate of 5 gpm. The residence time for the waste gas in reducing zone 2 is 0.5 seconds.

With the method of the present invention, the partially incinerated waste gas is introduced into the oxidizing zone 4, where additional oxygen in the form of combustion air is introduced into oxidizing zone 4 via conduit 20 which is in fluid communication with oxidizing zone input port 22. While FIG. 1 shows conduits 18 and 20 supplied with combustion air from a single source, it is to be understood that it is within the scope of the present invention for each of conduits 18 and 20 to be supplied from a unique source of combustion air. With the introduction of the combustion air into oxidizing zone 4, the PICs in the waste gas are oxidized to products of complete combustion. Due to the fact that the waste gas was cooled in reducing zone 2, its temperature remains lower in oxidizing zone 4. Thus, the peak temperature in oxidizing zone 4 is lower and thermal nitrogen oxide formation is thereby minimized in oxidizing zone 4.

In an alternative embodiment of the present invention, the method of the present invention further includes the step of reducing the nitrogen oxide content of the waste gas by injecting additional water into oxidizing zone 4 via conduit 24 which is in fluid communication with oxidizing zone input port 22. The additional water further cools the waste gas resulting in a further reduction in the formation of nitrogen oxides. Atomization of the water is preferred. Atomization may be achieved using high pressure water nozzles on the order of greater than 60 psig or by using part of the combustion air to atomize the water spray.

While flow rates and waste gas residence times in oxidizing zone 4 can vary dependent upon the scale of the operation involved, the equipment and flow rates obtained by the inventors is as follows. Combustion air conduit 20 was a 24 inch diameter metal pipe in which the combustion air flow was provided at a pressure of 10 inches w.c. and at a flow rate of 7000 scfm. Water injection conduit 24 was a 1 inch diameter metal pipe in which the water flow was provided at a pressure of 60 psig and a flow rate of 10 gpm. Residence time for the waste gas in oxidizing zone 4 was 1.0 second. Temperature ranges in oxidizing zone 4 without additional water were 1800° to 2000° F. Temperature ranges in oxidizing zone 4 with the input of additional water via conduit 24 were 1550° to 1650° F.

In still another embodiment, the method of the present invention further includes the step of mixing chemical reagents with the cooling water of either conduit 19 and/or conduit 24 prior to the injection of the water into the respective reducing zone 2 or oxidizing zone 4. The chemical reagents, in a preferred embodiment, are introduced via conduit 25 into conduit 19 and via conduit 26 into conduit 24, respectively, wherein the chemical reagents admix with the water of conduit 19 and conduit 24, respectively. The chemical reagents chemically reduce the nitrogen oxides formed in the reducing zone 2 in the waste gas. The chemical reagents further act to decrease the formation of nitrogen oxides in the oxidizing zone. The chemical reagents effective for chemically reducing the nitrogen oxides which may have been formed in the first zone, and which also function to decrease nitrogen oxide formation in the second zone, are characterized by H-N atomic bonds as part of their overall chemical structure. Preferred chemical reagents include one or more of cyanuric acid, urea or ammonium carbonate. Injection of an aqueous solution of these reagents provides a dual role of reducing both chemically bound nitrogen oxide formed in the reducing zone and preventing the formation of thermal nitrogen oxides in the oxidizing zone. In an alternative embodiment of the present invention, the chemical reagents are in the form of a slurry as opposed to an aqueous solution. By slurry, it is meant a heterogeneous mixture comprising solids and liquids, wherein much of the chemical reagent is not dissolved in the solvent, as contrasted with an aqueous solution in which the chemical reagents would be dissolved in the water phase to form a homogeneous solution.

It is to be noted that an important embodiment of the present invention resides in the admixing of the combustion air, water and chemical reagents before their introduction into thermal oxidizer 1. Important benefits obtained by this premixing include intimate contact of the chemical reagents with $NO_x$ molecules to enhance the efficiency of $NO_x$ reduction.

While different embodiments of the invention are shown and described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention which is to be given the full breadth of the appended claims and any and all equivalents thereof.

We claim:

1. A method for reducing nitrogen oxides in waste gas streams comprising the steps of:

a. injecting a waste gas containing chemically bound nitrogen from an upstream process into a first reducing zone of a staged thermal oxidizer, said staged thermal oxidizer further having a second oxidizing zone;

b. injecting natural gas from a natural gas source, cooling water from a water source and combustion air from a combustion air source into a burner firing into said first reducing zone;

c. admixing and igniting said natural gas, said cooling water and said combustion air within said burner in ratios sufficient to produce steam and a fuel rich atmosphere in said first reducing zone, wherein an operating temperature in said reducing zone is between 1500° F. to 1600° F. (815° C.–871° C.);

d. partially incinerating said waste gas in said first reducing zone;

e. transferring said partially incinerated waste gas from said first reducing zone into said second oxidizing zone;

f. injecting combustion air from a combustion air source into said second oxidizing zone, wherein said waste gas is fully oxidized; and g. expelling said waste gas from said staged thermal oxidizer.

2. The method of claim 1, wherein said method further comprises the steps of:

a. admixing said combustion air injected into said oxidizing zone with cooling water from a water source prior to injecting said combustion air into said oxidizing zone; and b. injecting said mixture of said cooling water and said combustion air into said oxidizing zone, wherein said cooling water reduces formation of nitrogen oxides in said oxidizing zone.

3. The method of claim 2, wherein said method further comprises the steps of:

a. selecting at least one chemical reagent based upon its ability to chemically reduce nitrogen oxides;

b. admixing said chemical reagent with said cooling water injected into said burner and/or said cooling water injected into said oxidizing zone to form a chemical reagent/cooling water mixture; and c. injecting said chemical reagent/cooling water mixture into either said burner and/or said oxidizing zone, whereupon formation of nitrogen oxides is prevented and wherein nitrogen oxides present are chemically reduced.

4. The method of claim 3, wherein said chemical reagent includes a H-N atomic bond.

5. The method of claim 4, wherein said chemical reagent is selected from the group consisting of cyanuric acid, urea and ammonium carbonate.

6. The method of claim 1, wherein said temperature in said oxidizing zone is between 1550° F. to 1650° F.

7. The method of claim 1 including the step of separating said first reducing zone and said oxidizing zone by an air curtain.

8. The method of claim 1, wherein said water is admixed with said natural gas before entering said burner.

9. The method of claim 1, wherein the residence time for the waste gas in said reducing zone is 0.5 seconds.

10. The method of claim 1, wherein the residence time for the waste gas in said oxidizing zone is 1.0 second.

11. The method of claim 3, wherein said chemical reagent, combustion air and cooling water are admixed before being injected into said burner.

12. The method of claim 3, wherein said chemical reagent cooling water mixture is in the form of a slurry.

* * * * *